US007098582B2

(12) United States Patent
Kim

(10) Patent No.: US 7,098,582 B2
(45) Date of Patent: Aug. 29, 2006

(54) CATHODE RAY TUBE HAVING AN IMPROVED SHADOW MASK

(75) Inventor: Yong Kun Kim, Gumi-si (KR)

(73) Assignee: LG. Philips Displays Korea Co., Ltd., Gumi-Si (KR)

( * ) Notice: Subject to any disclaimer, the term of this patent is extended or adjusted under 35 U.S.C. 154(b) by 199 days.

(21) Appl. No.: 10/717,512

(22) Filed: Nov. 21, 2003

(65) Prior Publication Data

US 2004/0263047 A1 Dec. 30, 2004

(30) Foreign Application Priority Data

Jun. 30, 2003 (KR) ..... 10-2003-0043290

(51) Int. Cl.
*H01J 29/81* (2006.01)
*H01J 29/07* (2006.01)

(52) U.S. Cl. ..... 313/402; 313/407; 313/408

(58) Field of Classification Search ..... 313/402, 313/407, 408
See application file for complete search history.

(56) References Cited

U.S. PATENT DOCUMENTS 5,155,410 A * 10/1992 Wakasono et al. ..... 313/402
6,025,676 A * 2/2000 Ohama et al. ..... 313/477 R
6,448,706 B1 * 9/2002 Kawamura et al. ..... 313/477 R
6,590,327 B1 * 7/2003 Furusawa et al. ..... 313/402
6,593,685 B1 * 7/2003 Kim ..... 313/407
6,628,060 B1 * 9/2003 Shimizu et al. ..... 313/408
6,650,071 B1 * 11/2003 Elshof ..... 315/398
6,674,225 B1 * 1/2004 Jung ..... 313/402
6,879,094 B1 * 4/2005 Choi ..... 313/402
6,998,765 B1 * 2/2006 Kim ..... 313/402
2001/0018309 A1 * 8/2001 Nishiki et al. ..... 445/30
2002/0195920 A1 * 12/2002 Furusawa et al. ..... 313/402

* cited by examiner

*Primary Examiner*—Allen C. Ho
(74) *Attorney, Agent, or Firm*—Birch, Stewart, Kolasch & Birch, LLP

(57) ABSTRACT

A cathode ray tube comprises a panel having a fluorescent formed on an inner surface thereof; a funnel connected to the panel; an electron gun housed in the funnel emitting electron beams; a deflection yoke for deflecting the electron beams in horizontal and vertical directions; a shadow mask for selecting colors of the electron beams; and a mask frame for supporting the shadow mask, in which an outer surface of the panel is substantially flat and an inner surface has a designated curvature, and a radius of curvature from a center of the shadow mask in a major-axis, minor-axis and diagonal-axis direction is substantially same.

23 Claims, 7 Drawing Sheets

CATHODE RAY TUBE HAVING AN IMPROVED SHADOW MASK

This Nonprovisional application claims priority under 35 U.S.C. § 119(a) on Patent Application No(s). 10-2003-0043290 filed in Korea on Jun. 30, 2003, the entire contents of which are hereby incorporated by reference.

BACKGROUND OF THE INVENTION

1. Field of the Invention

The present invention relates to a cathode ray tube, more particularly, to a cathode ray tube including a shadow mask having an improved drop characteristic by adjusting a curvature thereof.

2. Discussion of the Background Art

FIG. 1 illustrates the structure of a related art color cathode ray tube.

As depicted in FIG. 1, a panel 1 and a funnel 2 of the color cathode ray tube are sealed up (or connected) tightly together, so the inside of the cathode ray tube is generally in a vacuum state.

To see the structure of the cathode ray tube, a fluorescent screen 3 with red (R), green (G) and blue (B) primary color phosphors (or fluorescent substances) is formed inside of the panel 1, and an electron gun 4 for emitting three color electron beams 7, namely red, green and blue, is housed in the neck portion of the funnel on the opposite side of the fluorescent screen 3.

A shadow mask 5 having a color selecting function is disposed at a predetermined space between the fluorescent screen 3 and the electron gun 4, more specifically, closer to the fluorescent screen 3. Also, in order to restrict the motion of the electron beams 7 promoted by a magnetic field, an inner shield 6, which is made of magnetic substance, is provided to a rear side of the cathode ray tube to diminish an influence of a magnetic field thereon.

Meanwhile, there is a convergence purity correcting magnet (CPM) 8 in the neck portion of the funnel 2, which serves to adjust R, G and B electron beams emitted from the electron gun 4 to be converged to one single point, and in front of the magnet 8, there is a deflection yoke 9 for deflecting the electron beams 7.

In addition, a reinforcing band 10 is put on the external skirt area of the panel so as to reinforce a front surface glass with the presence of a high internal vacuum state. In other words, since the cathode ray tube is highly evacuated, it can be easily exploded by external impacts. To obviate this problem, the panel is specially designed to be able to sustain atmospheric pressure. As aforementioned, the reinforcing band 10 is clamped to the external skirt area of the panel 1, dispersing stress upon the highly evacuated cathode ray tube and thereby, making the panel resistant to external impacts.

To briefly explain how the color cathode ray tube with the above construction operates, the electron beams 7 emitted from the electron gun 4 are deflected in the horizontal and vertical directions according to the deflection yoke 9, and the deflected electron beams 7 pass through a beam passing hole on the shadow mask 5 and eventually strike the fluorescent screen 3 on the front side, thereby displaying a desired color image.

FIG. 2 illustrates a related art shadow mask and mask spring.

Referring to FIG. 2, the shadow mask 5 is attached to a mask frame 11, and the mask frame 11 is coupled onto an inner surface of a panel 1 by a mask spring 12. Although the shadow mask 5 in the drawing is welded to a welding portion 15 of the inner surface of the mask frame 11, it can also be welded to an outer surface of the mask frame 11.

Electron beam passing holes formed on the shadow mask 5 select colors of electron beams, and when the electron beams strike a front surface of a fluorescent screen 3, a desired image is displayed on the screen.

As depicted in FIG. 2, X-axis is a major-axis direction, Y-axis is a minor-axis direction, and D-axis is a diagonal-axis direction. In each direction, a different curvature is fixed, and thus has a different impact resistance from external impacts.

Also, Z-axis is a perpendicular direction from a center portion of the shadow mask.

When external impacts are given to the shadow mask 5, the center portion is sometimes recessed (dropped) or peripheral portion is sometimes distorted.

To improve a drop characteristic against external impacts, manufacturers have used different materials for the shadow mask 5, or changed a welding position, or formed a plurality of embossments thereon.

Particularly, external impacts on the shadow mask are biggest in the normal direction of the curved surface. As shown in FIG. 3, since the major-axis direction curvature the shadow mask 5 is great, external impacts F are not applied directly or fully in that direction, and thus the shadow mask is not severely distorted.

On the other hand, the minor-axis direction curvature of the shadow mask 5 is not large. Thus, external impacts F are almost perpendicularly applied in that direction, and as a result, the shadow mask 5 is very severely distorted.

FIG. 5 graphically illustrates a relation between external impacts F and distortion amounts of the shadow mask 5.

As shown on the graph, as an external impacts F is increased, the amount of distortion of the shadow mask 5 also increases proportionally, and at A point, it is no longer increased in proportion to the external impacts F. However, after B point, the amount of distortion of the shadow mask 5 is again increased in proportion to the external impact F.

Between A point and B point, a buckling phenomenon occurs, so even if the external impact F is absent, the shadow mask 5 does not return to its original shape.

That is to say, when the curvature of the shadow mask 5 is distorted by the external impact F, the shadow mask cannot select colors of electron beams more effectively, and this causes deteriorations in picture quality of a cathode ray tube.

Many attempts have been made to solve the above problem. One of them is changing material and thickness of the shadow mask 5 to reinforce drop characteristics of the shadow mask 5.

For example, a material having a high Young's modulus value was used or the thickness of the shadow mask was increased in order to strengthen the drop characteristics.

However, these traditional methods only increased price of the shadow mask 5.

As an alternative, manufacturers tried to make the curved surface of the shadow mask 5 close to a welding point to which the shadow mask 5 and the mask frame 11 are welded by increasing the height of the welding point. However, this method also gave rise to a side effect that the shadow mask 5 and the mask frame 11 were thermally expanded severely, resultantly deteriorating a doming characteristic of the shadow mask 5.

Other manufacturers suggested forming a plurality of embossments on the shadow mask 5. Unfortunately however, the effect thereof was not significant, and it only made it difficult to form a curved surface for the shadow mask 5.

FIG. 6 shows different radius of curvature of a related art shadow mask.

More specifically, the graph in FIG. 6 illustrates the relation between a radius of curvature of the shadow mask and a distance from the shadow mask center in a major-axis, minor-axis and diagonal-axis direction, respectively.

As shown on the graph, the radius of curvature is largest from the center of the shadow mask to the minor-axis direction, and gradually reduces in order of the diagonal-axis and major-axis directions.

That is to say, in case of the related art shadow mask, the radius of curvature in the minor-axis direction, Ry, the radius of curvature in the diagonal-axis direction, Rd, and the radius of curvature in the major-axis direction, Rx, satisfy a relation of Rx<Rd<Ry. This relation is maintained not only at the central portion of the shadow mask but also in the peripheral portion of the shadow mask.

Here, a large radius of curvature means that the surface is flat. Therefore, as discussed before with reference of FIG. 3, the shadow mask is relatively more flat and thus weaker in the minor-axis direction than in the major-axis or diagonal-axis directions, experiencing more of external impacts.

In short, the related art shadow mask posed a problem that its strength in the minor-axis direction is relatively weak, eventually influencing on the overall quality of the shadow mask and deteriorating a picture quality of the cathode ray tube.

SUMMARY OF THE INVENTION

An object of the invention is to solve at least the above problems and/or disadvantages and to provide at least the advantages described hereinafter.

Accordingly, one object of the present invention is to solve the foregoing problems by providing a cathode ray tube including a shadow mask with a maximized drop strength by restring a radius of curvature in a major-axis, minor-axis and diagonal-axis direction, respectively, to be a substantially same range.

Another object of the present invention is to provide a cathode ray tube including a shadow mask with an improved structure for having a maximized drop strength, independent of kinds of materials being used for the shadow mask, so that even a shadow mask made of relatively lower-priced materials can have an equally good drop strength.

Another object of the invention is to provide a cathode ray tube with an improved picture quality by minimizing distortions of a shadow mask due to external impacts.

The foregoing and other objects and advantages are realized by providing a cathode ray tube comprising: a panel having a fluorescent formed on an inner surface thereof; a funnel connected to the panel; an electron gun housed in the funnel emitting electron beams; a deflection yoke for deflecting the electron beams in horizontal and vertical directions; a shadow mask for selecting colors of the electron beams; and a mask frame for supporting the shadow mask, wherein an outer surface of the panel is substantially flat and an inner surface has a designated curvature, and a radius of curvature from a center of the shadow mask in a major-axis, minor-axis and diagonal-axis direction is substantially same.

Another aspect of the invention provides a cathode ray tube comprising: a panel having a fluorescent formed on an inner surface thereof; a funnel connected to the panel; an electron gun housed in the funnel, emitting electron beams; a deflection yoke for deflecting the electron beams in horizontal and vertical directions; a shadow mask for selecting colors of the electron beams; and a mask frame for supporting the shadow mask, wherein an outer surface of the panel is substantially flat and an inner surface has a designated curvature, and if a radius of curvature from a center of the shadow mask in a major-axis direction is Rxo, a radius of curvature in a minor-axis direction Ryo, and a radius of curvature in a diagonal-axis direction Rdo, the Rxo, Ryo and Rdo are greater than 85% of a maximum value among the Rxo, Ryo and Rdo.

Another aspect of the invention provides a cathode ray tube comprising: a panel having a fluorescent formed on an inner surface thereof; a funnel connected to the panel; an electron gun housed in the funnel emitting electron beams; a deflection yoke for deflecting the electron beams in horizontal and vertical directions; a shadow mask for selecting colors of the electron beams; and a mask frame for supporting the shadow mask wherein an outer surface of the panel is substantially flat and an inner surface has a designated curvature, and if a minor-axis direction length of the shadow mask is H, a radius of curvature from a center of the shadow mask in a major-axis direction is Rxo, a radius of curvature in a minor-axis direction Ryo, and a radius of curvature in a diagonal-axis direction Rdo, the Rxo, Ryo and Rdo within the length H/12 from the center of the shadow mask satisfy a condition of $$\frac{\mathrm{Max}(Rxo, Ryo, Rdo) - \mathrm{Min}(Rxo, Ryo, Rdo)}{\mathrm{Max}(Rxo, Ryo, Rdo)} \leq 0.15.$$

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a cathode ray tube according to a preferred embodiment of the invention in reference to the accompanying drawings.

Figure 7:
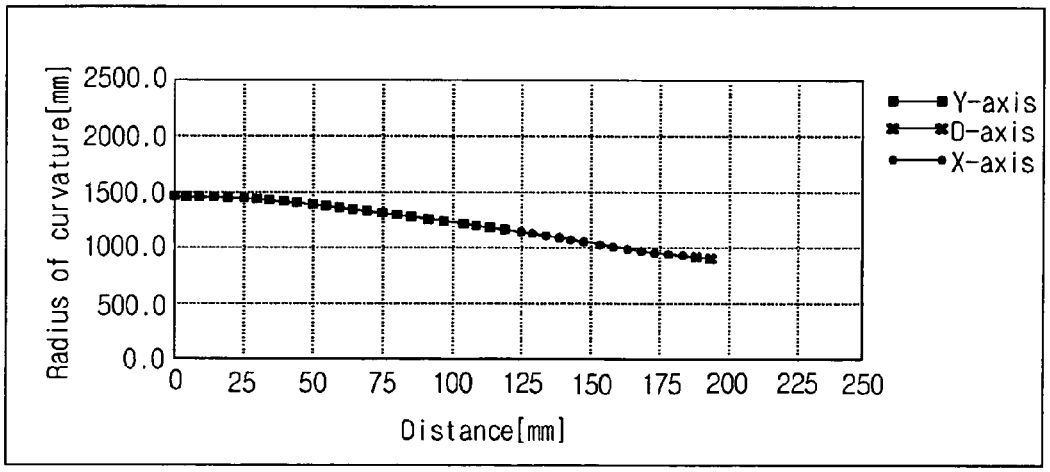
FIG. 7 illustrates radii of curvature of a shadow mask in a cathode ray tube according to an embodiment of the present invention.

FIG. 7 illustrates radii of curvature of a shadow mask in a cathode ray tube according to an embodiment of the present invention, depending on a distance from a center of the shadow mask.

Referring to FIG. 7, the radius of curvature in a major-axis and diagonal-axis direction, respectively, of the shadow mask of the cathode ray tube of the invention is substantially same.

That is to say, as a distance from the center of the shadow mask is increased, the radius of curvature in the respective directions (major-axis, minor-axis and diagonal-axis directions) is not much different from one another, showing a substantially equal change.

Figure 1:
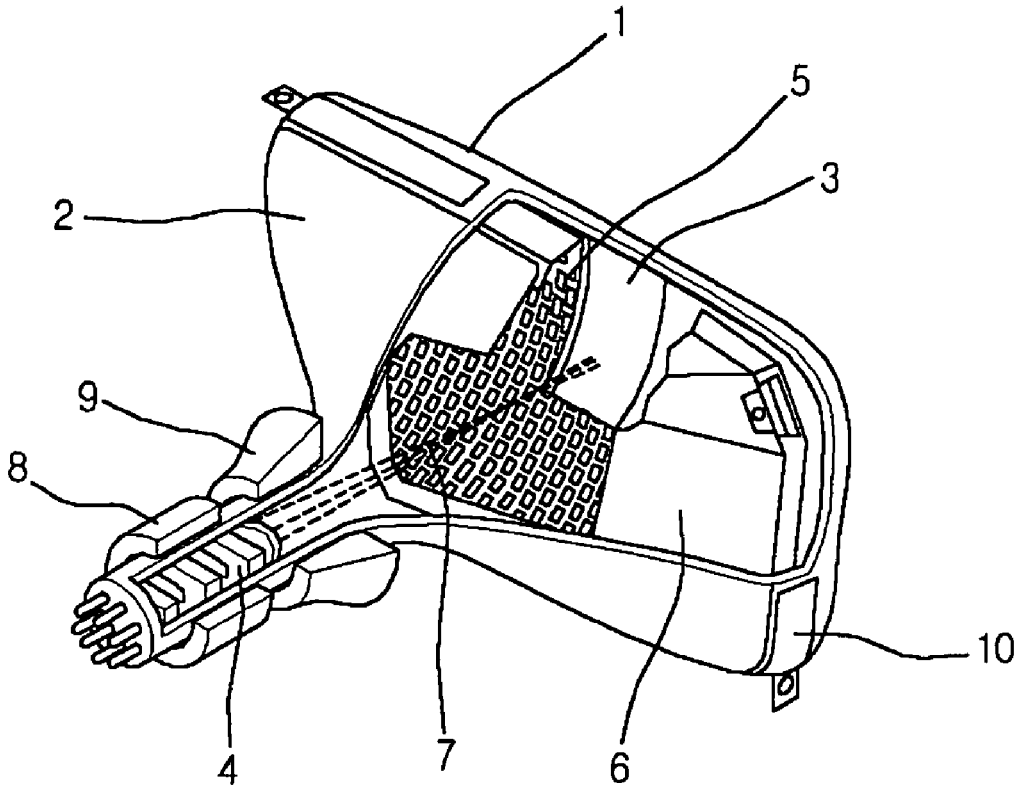
Fig.1 Related Art
FIG. 1 illustrates a structure of a related art color cathode ray tube.
Figure 2:
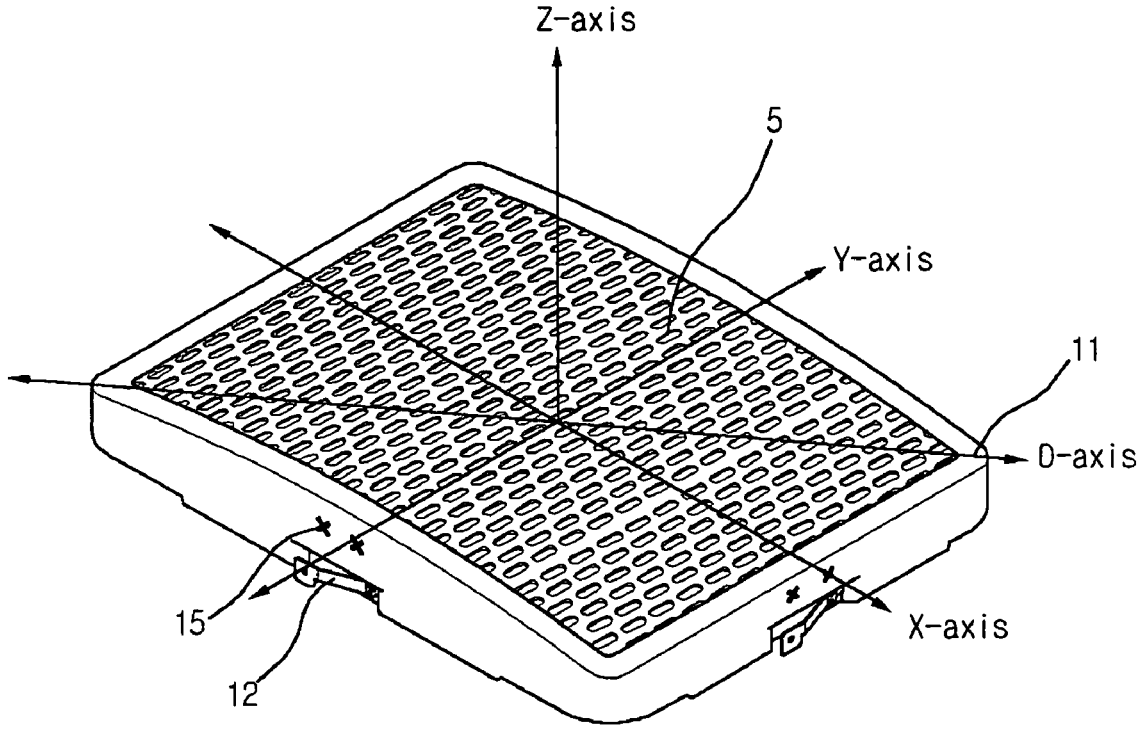
Fig.2 Related Art
FIG. 2 illustrates a related art shadow mask and mask spring.
Figure 3:
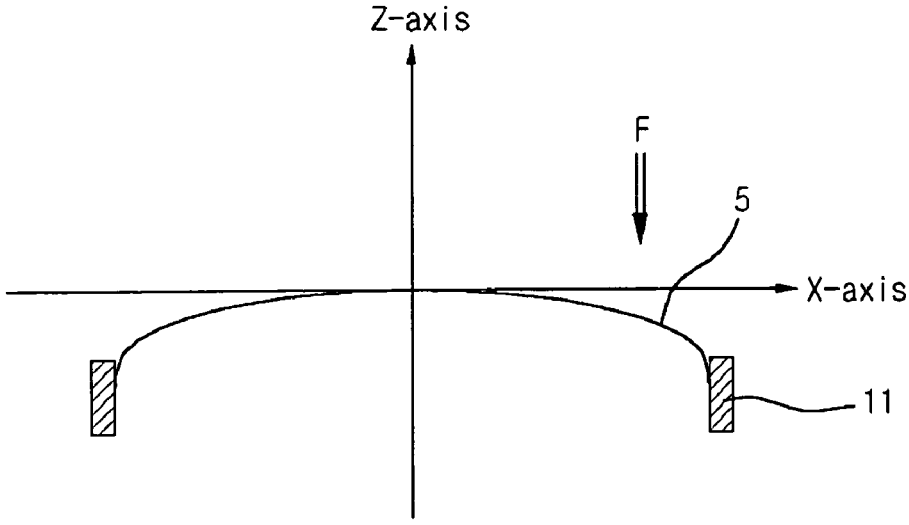
Fig.3 Related Art
FIG. 3 illustrates a curvature in a major-axis direction on a shadow mask and external impacts thereon.
Figure 4:
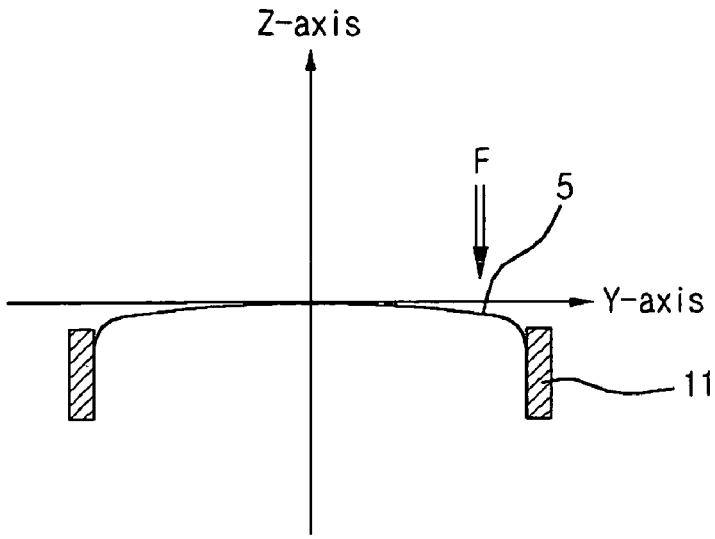
Fig.4 Related Art
FIG. 4 illustrates a curvature in a minor-axis direction on a shadow mask and external impacts thereon.
Figure 5:
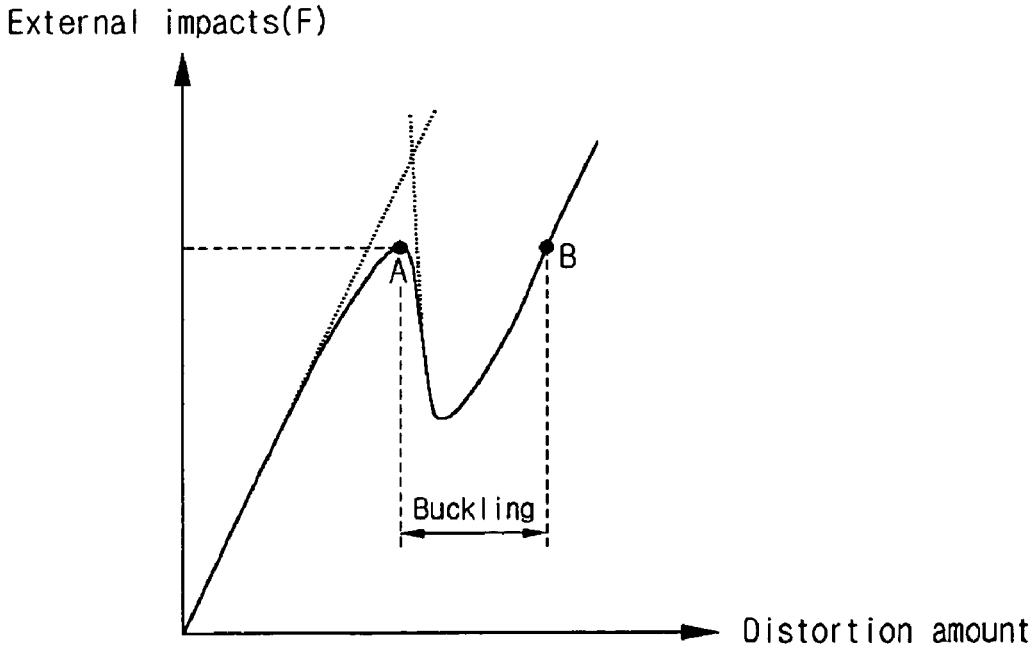
Fig.5 Related Art
FIG. 5 graphically depicts distortion amounts of a shadow mask caused by external impacts (F)
Figure 6:
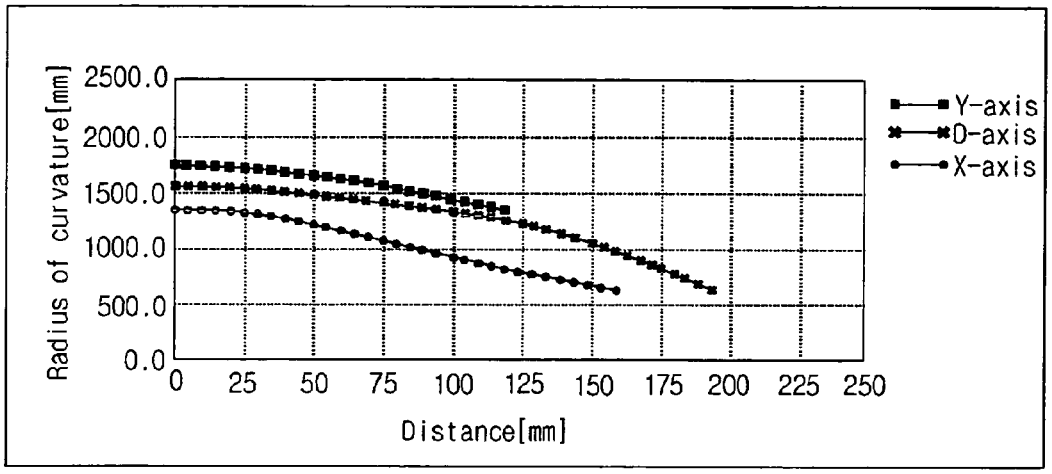
Fig.6 Related Art
FIG. 6 is a graph illustrating a relation between radii of curvature of a shadow mask and a distance from a center of the shadow mask in a major-axis, minor-axis, and diagonal-axis direction, respectively.

Compared with the result obtained from a related art shadow mask in FIG. 6, the radius of curvature of the shadow mask of the embodiment of the present invention is shorter in the minor-axis direction and longer in the major-axis direction, so the radii of curvature in the major-axis, minor-axis and diagonal-axis directions are substantially same.

As the radius of curvature in the minor-axis direction got shorter, impact resistance against external impacts on that portion got stronger, and thus, the drop strength was improved. On the other hand, as the radius of curvature in the major-axis direction got longer, the drop strength on that portion got weaker.

However, since a distance from the center of the shadow mask to an end of an effective surface in the major-axis direction is relatively greater than as in the minor-axis direction and a Z-value thereon is also relatively larger, the influence of an increase in the radius of curvature upon the drop strength is not significant. Here, the Z-value refers to a height difference between the center of the shadow mask and a point on the shadow mask Generally, the Z-values are expressed as positive (+) values.

For a better understanding about the relation between the Z-value and the radius of curvature, suppose that there is a point having the same distance from the shadow mask center. Then on that point, if the radius of curvature is increased, the Z-value is decreased, and if the radius of curvature is decreased, the Z-value is increased.

As discussed before, in the cathode ray tube of the present embodiment, the radii of curvature in the respective directions of the shadow mask are designed to be substantially the same. Therefore, when external impact is applied to the shadow mask the impact is equally distributed in the major-axis, minor-axis and diagonal-axis directions of the shadow mask thereby improving the drop strength.

To explain the present embodiment by means of a radius of curvature expansion of the shadow mask the following equation can be obtained.

Here, Z-value (mm) denotes a height difference between the center of the shadow mask and a point on the shadow mask; x and y (mm) respectively denotes a coordinate value of each point on the shadow mask, using the center of the shadow mask as a central point of coordinates; and a, b, c, d, e, f, g and h are constants that determine a pattern of a radius of curvature of the shadow mask Therefore, a, b, c, d, e, f, g and h are variable, depending on a design of the shadow mask. As these a, b, c, d, e, f, g and h values change, the Z-value associated with the x- and y-coordinates, using the shadow mask center as the central point, is also changed, and this is the change that determines the radius of curvature of the shadow mask In the above expansion, the first half variables, namely $ax^2+bx^4+cy^2+dy^4$, are the ones that actually determine the radius of curvature of the shadow mask, and the other half variables, $ex^2y^2+fx^4y^2+gx^2y^4+hx^4y^4$, determine the radius of curvature at a particular portion since e, f, g and h values are very small.

More specifically, the radius of curvature in the major-axis direction is determined by the constants a and b, and the radius of curvature in the minor-axis direction is determined by the constants c and d. For instance, the α-value is approximately $3\times10^{-4}$, the b-value is approximately $6\times10^{-10}$. Similarly, the c-value is approximately $3\times10^{-4}$, and the d-value is approximately $6\times10^{-10}$.

In the above expansion, what really determines the curvature radius decrease pattern of the shadow mask are the ratios b/a and d/c. Depending on these b/a and d/c values, the curvature radius decrease patterns in the major-axis and minor-axis directions can be determined. If the b/a value and the d/c value are great, it means that the Z-value is large with respect to the same x and y values. And, when the b/a and d/c values are increased, the degree of decrease of the radius of curvature gets severe.

However, in case of the shadow mask of the cathode ray tube according to the embodiment of the present invention, the radius of curvature in each direction (major-axis, minor-axis and diagonal-axis direction) is substantially same with one another, so its decrease pattern is also same.

In other words, the b/a value is substantially the same as the d/c value. Particularly in the invention, the b/a value is designed to be in a range of $2.2\times10^{-6}<b/a<4.4\times10^{-6}$, and the d/c value is also in the range of $2.2\times10^{-6}<d/c<4.4\times10^{-6}$.

Defining the b/a value and the d/c value in terms of $\alpha\times10^{-6}$, the α-value satisfies a condition of $2.2<\alpha<4.4$.

Figure 8:
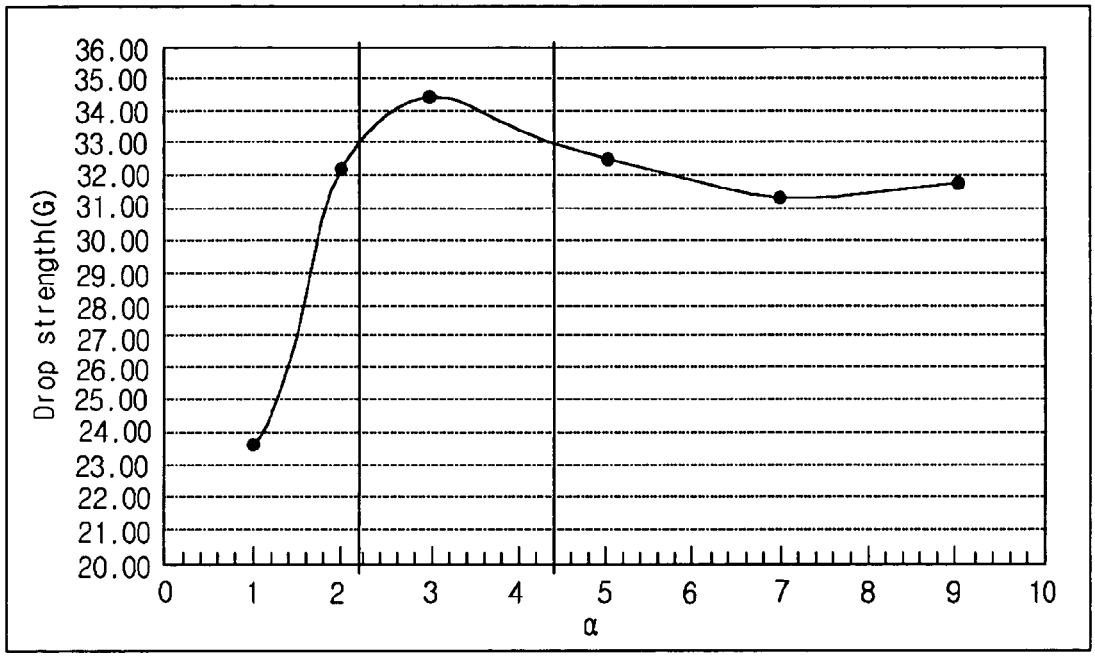
FIG. 8 is a graph illustrating a relation between drop strength and α-value of a cathode ray tube according to an embodiment of the present invention.

FIG. 8 illustrates how the drop strength changes in accordance with different α-values.

Here, the α-value indicates a curvature radius decrease pattern of the shadow mask. In the invention, the curvature radius decrease patterns in the major-axis, minor-axis and diagonal-axis directions preferably follow the α-value. If not all, the curvature radius decrease pattern of at least one of the directions should satisfy the α-value.

As shown in FIG. 8, the drop strength is determined, depending on changes of the α-values.

More specifically speaking, supposing that the Z-value at the end of an effective surface in the diagonal-axis direction on the shadow mask that is, the height difference between the shadow mask center and the end of the effective surface in the diagonal-axis direction on the shadow mask is same, the drop strength of the shadow mask having a related art radius of curvature was approximately 32G.

However, when the α-value condition is met (2.2<α<4.4), the drop strength of the shadow mask can be not less than 33G.

Figure 9:
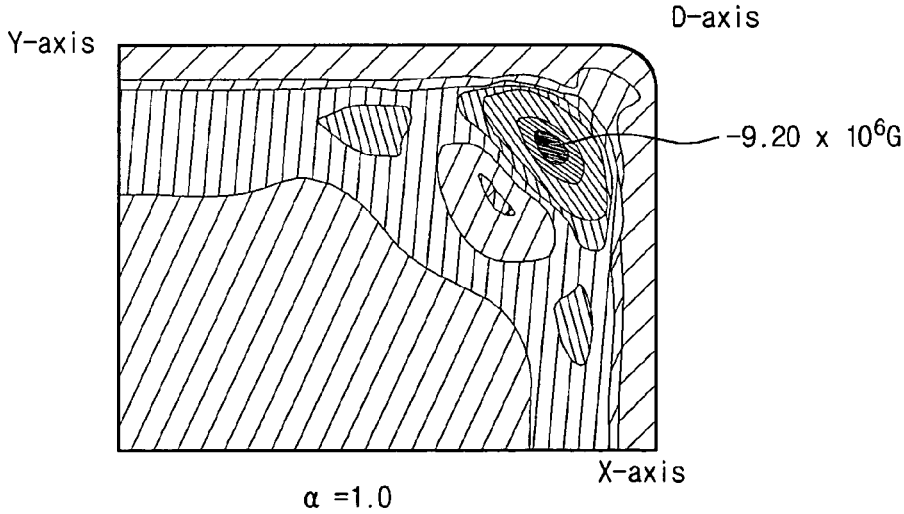
FIG. 9 depicts a compressive stress applied to an end of an effective surface in a diagonal-axis direction on a shadow mask, given that α-value is 1.0.

In the drawing, in case that the α-value is not greater than 2.2, the curvature radius decrement is low. As illustrated in FIG. 9, when the α-value is 1.0, the end of the effective surface in the diagonal-axis direction on the shadow mask is under a severe compressive stress ($-9.2\times10^6$ G).

Figure 10:
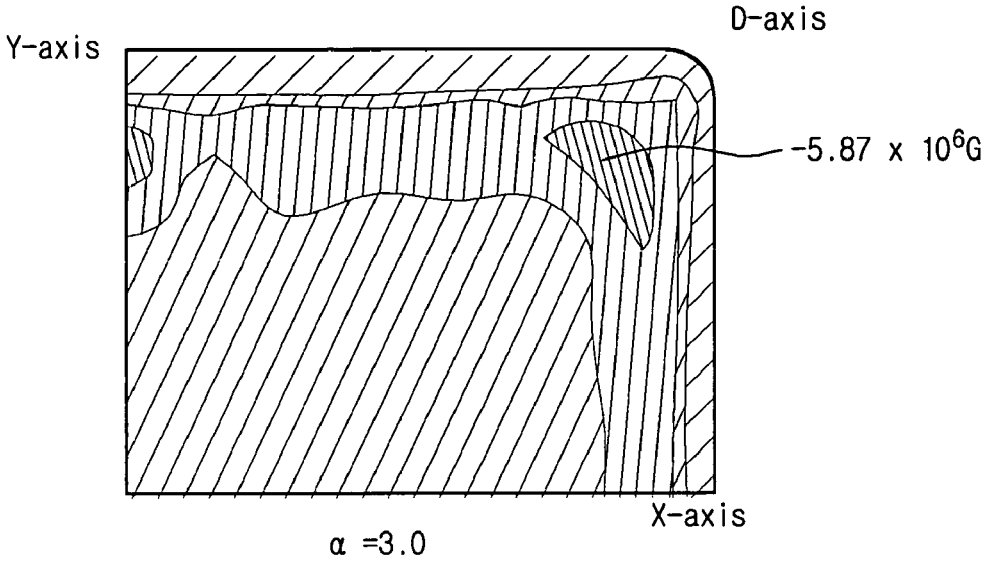
FIG. 10 depicts a compressive stress applied to a shadow mask given that α-value is 7.0.
Figure 11:
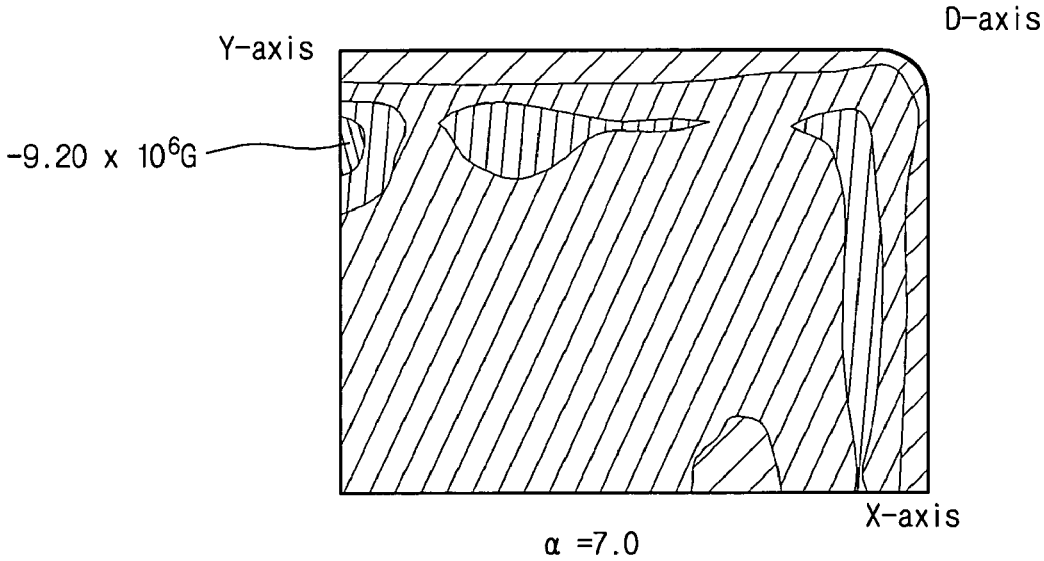
FIG. 11 depicts a compressive stress applied to a shadow mask, given that α-value is 7.0.

When the α-value is not less than 4.4, the curvature radius decrement is rapidly increased in a direction from the center of the shadow mask to the peripheral portion. Also, if the α-value is 7.0, as shown in FIG. 11, the radius of curvature at the central portion is relatively larger, and a maximum compressive stress ($-6.54\times10^6$ G) spot is shifted to the minor-axis direction. In such case, the compressive stress is non-uniformly distributed throughout the shadow mask On the other hand, if the α-value satisfies the condition of 2.2<α<4.4, say 3.0 as shown in FIG. 10, the compressive stress is uniformly distributed throughout the shadow mask and the maximum compressive stress is $-5.87\times10^6$ G, which is relatively small compared to the before.

As such, restricting the radius of curvature and the curvature radius decrease pattern in the respective directions on the shadow mask to be substantially same, it is possible to uniformly distribute external impacts throughout the shadow mask and thus, to improve the drop strength thereof.

In addition, restricting the α-values in the curvature radius decrease pattern for each of the directions (major-axis, minor-axis and diagonal-axis directions) to be in the range of 2.2<α<4.4, the maximum compressive stress is reduced, and the stress can be uniformly distributed.

However, the radius of curvature of the shadow mask is largely influenced by an inside surface radius of curvature of a panel. Thus, Z-values of the ends of effective surfaces in the major-axis, minor-axis and diagonal-axis directions are often changed as well.

In fact, it is very difficult to make the radii of curvature in the respective directions on the shadow mask be the same with one another.

Suppose that the radius of curvature in the major-axis direction from the shadow mask center is Rxo, the radius of curvature in the minor-axis direction is Ryo, and the radius of curvature in the diagonal-axis direction is Rdo. Then, the Rxo, Ryo and Rdo are not less than 85% of a maximum radius of curvature.

That is, if the radius of curvature in the major-axis direction (Rxo) from the center of the shadow mask has a maximum value, the other two radii of curvature, namely the radius of curvature in the minor-axis direction (Ryo) and the radius of curvature in the diagonal-axis direction (Rdo), should be at least 85% of the maximum value.

More preferably, those two radii of curvature, namely the radius of curvature in the minor-axis direction (Ryo) and the radius of curvature in the diagonal-axis direction (Rdo), should be at least 88% of the maximum value.

Also, suppose that a perpendicular distance of the effective surface of the shadow mask, that is, a minor-axis direction length, is H Then, the Rxo, Ryo and Rdo should have their radii of curvature being not less than 85% of the maximum value within at least the length H/12 from the center of the shadow mask To be short, within the length H/12 from the center of the shadow mask, the Rxo, Ryo and Rdo preferably satisfy a condition of $$\frac{\mathrm{Max}(Rxo, Ryo, Rdo) - \mathrm{Min}(Rxo, Ryo, Rdo)}{\mathrm{Max}(Rxo, Ryo, Rdo)} \leq 0.15$$

When the above condition is met, the drop strength of the shadow mask is greatly improved.

But since the drop strength in the minor-axis direction is the weakest, Ryo among Rxo, Ryo and Rdo should have the lowest value.

Figure 12:
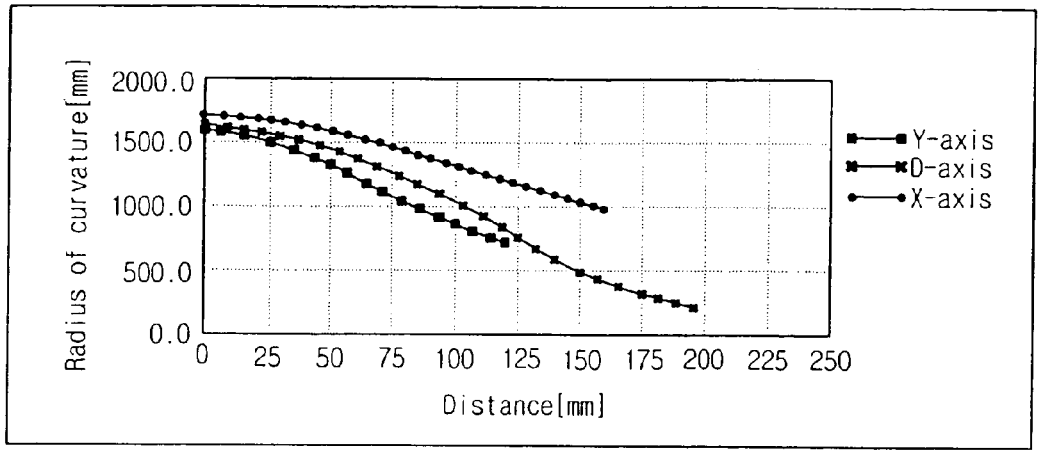
FIG. 12 is a graph illustrating a radius of curvature in each direction on a shadow mask of a cathode ray tube according to the present invention.

FIG. 12 illustrates an optimum radius of curvature in the respective directions where the above condition is met.

Figure 13:
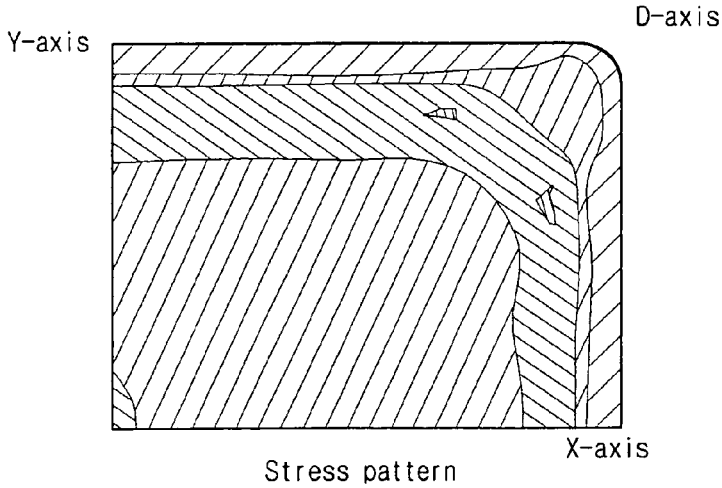
FIG. 13 depicts a distribution of stress applied on a shadow mask of a cathode ray tube according to the present invention.

With these radii of curvature shown in FIG. 12, stress is uniformly distributed throughout the shadow mask, as depicted in FIG. 13.

In this manner, the drop strength against external impacts can be improved.

Given that the α-value is in the range of 2.2<α<4.4 as discussed in FIG. 8, the radius of curvature in the major-axis direction from the shadow mask center, Rxo, the radius of curvature in the minor-axis direction, Ryo, the radius of curvature in the diagonal-axis direction, Rdo, the radius of curvature at the end of the effective surface in the major-axis direction of the shadow mask, Rxf, the radius of curvature at the end of the effective surface in the minor-axis direction, Ryf, and the radius of curvature at the end of the effective surface in the diagonal-axis direction, Rdf, satisfy the following relations (in %):

62.6%<Rxf/Rxo<77.6%

74.9%<Ryf/Ryo<86.1%

52.1%<Rdf/Rdo<69.2%.

In reality, however, the radii of curvature in the respective directions of the shadow mask and the Z-values can be always varied, depending on designs of the panel, and deflection and arrangement of electron beams is another factor that needs to be taken into consideration. Hence, a more preferable relations of Rxf/Ryo and Rdf/Rdo for improving the drop strength are as follows:

44.7%<Rxf/Rxo<77.6%

59.0%<Ryf/Ryo<86.1%

34.6%<Rdf/Rdo<69.2%.

According to the results from the above embodiment, when a thickness of the shadow mask is 0.1 mm, the drop strength was increased from 24.9G to 28.1G, showing 11.4% of an increase. Also, when a thickness of the shadow mask is 0.13 mm, the drop strength was increased from 32.4G to 36.4G, showing 11.0% of an increase.

As long as the above condition is met, the drop strength of the shadow mask can be improved.

Generally, in a cathode ray tube including a panel of which outer surface is substantially flat and inner surface has a designated curvature, the radius of curvature of a shadow mask is also increased to correspond to the inner surface of the panel. In doing so, the strength of the shadow mask gets weaker rapidly. However, this problem can be fixed by the application of the above-discussed embodiment.

Preferably, transmittance at a central portion of the panel in the cathode ray tube of the invention is in a range of 45–75%.

Also, the strength of the shadow mask is no longer weakened severely even when the thickness of the shadow mask needs to be reduced to 0.1 mm and less for cost reduction and high-resolution etching.

The shadow mask in the cathode ray tube of the invention has maximum drop strength by restring a radius of curvature in the respective major-axis, minor-axis and diagonal-axis directions to be a substantially same range.

Moreover, the shadow mask in the cathode ray tube of the invention has the improved structure for having the maximum drop strength, independent of kinds of materials being used for the shadow mask so that even a shadow mask made of relatively lower-priced materials can have an equally good drop strength Lastly, the cathode ray tube of the invention has an excellent picture quality by minimizing distortions in the shadow mask caused by external impacts.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A cathode ray tube, comprising:

a panel having a fluorescent formed on an inner surface thereof;

a funnel connected to the panel;

an electron gun housed in the funnel, emitting electron beams;

a deflection yoke for deflecting the electron beams in horizontal and vertical directions;

a shadow mask for selecting colors of the electron beams; and a mask frame for supporting the shadow mask, wherein an outer surface of the panel is substantially flat and an inner surface has a designated curvature, wherein a radius of curvature from a center of the shadow mask in a major-axis, minor-axis and diagonal-axis direction is substantially the same, and wherein the shadow mask satisfies a curvature radius expansion expressed by $Z(x, y)=ax^2+bx^4+cy^2+dy^4+ex^2y^2+fx^4y^2+gx^2y^4+hx^4y^4$, b/a satisfies a condition of $2.2\times10^{-6}<b/a<4.4\times10^{-6}$, x and y being a distance (mm) from the center of the shadow mask to a point respectively, and Z being a height difference (mm) between the center of the shadow mask and the point on the shadow mask.

2. The cathode ray tube according to claim 1, wherein radii of curvature of the shadow mask are substantially the same within the length H/12 from the center of the shadow mask, H being a minor-axis direction length of the shadow mask.

3. The cathode ray tube according to claim 1, wherein radii of curvature of the shadow mask are substantially the same as a distance from the center of the shadow mask is increased in the major-axis, minor-axis and diagonal-axis directions.

4. The cathode ray tube according to claim 1, wherein the shadow mask satisfies a curvature radius expansion expressed by $Z(x, y)=ax^2+bx^4+cy^2+dy^4+ex^2y^2+fx^4y^2+gx^2y^4+hx^4y^4$, d/c satisfies a condition of $2.2\times10^{-6}<d/c<4.4\times10^{-6}$, x and y being a distance (mm) from the center of the shadow mask to a point respectively, and Z being a height difference (mm) between the center of the shadow mask and the point on the shadow mask.

5. The cathode ray tube according to claim 1, wherein the shadow mask satisfies a curvature radius expansion expressed by $Z(x, y)=ax^2+bx^4+cy^2+dy^4+ex^2y^2+fx^4y^2+gx^2y^4+hx^4y^4$, b/a satisfies a condition of $2.2\times10^{-6}<b/a<4.4\times10^{-6}$, and d/c satisfies a condition of $2.2\times10^{-6}<d/c<4.4\times10^{-6}$, x and y being a distance (mm) from the center of the shadow mask to a point respectively, and Z being a height difference (mm) between the center of the shadow mask and the point on the shadow mask.

6. The cathode ray tube according to claim 1, wherein the radius of curvature from a center of the shadow mask in a major-axis direction is Rxo, the radius of curvature in a minor-axis direction Ryo, and the radius of curvature in a diagonal-axis direction Rdo, the Ryo has the lowest value among the Rxo, Ryo and Rdo.

7. The cathode ray tube according to claim 1, wherein a thickness of the shadow mask is not greater than 0.1 mm.

8. The cathode ray tube according to claim 1, wherein a transmittance at a central portion of the panel is in a range of 45–75%.

9. A cathode ray tube comprising:

a panel having a fluorescent formed on an inner surface thereof;

a funnel connected to the panel;

an electron gun housed in the funnel, emitting electron beams;

a deflection yoke for deflecting the electron beams in horizontal and vertical directions;

a shadow mask for selecting colors of the electron beams; and a mask frame for supporting the shadow mask, wherein an outer surface of the panel is substantially flat and an inner surface has a designated curvature, wherein a radius of curvature from a center of the shadow mask in a major-axis direction is Rxo, a radius of curvature in a minor-axis direction Ryo, and a radius of curvature in a diagonal-axis direction Rdo, the Rxo, Ryo and Rdo are not less than 85% of a maximum value among the Rxo, Ryo and Rdo, and wherein the radius of curvature in the major-axis direction from the shadow mask center is Rxo, the radius of curvature in the minor-axis direction Ryo, the radius of curvature in the diagonal-axis direction Rdo, a radius of curvature at an end of an effective surface in the major-axis direction of the shadow mask Rxf, a radius of curvature at an end of the effective surface in the minor-axis direction Ryf, and a radius of curvature at an end of the effective surface in the diagonal-axis direction Rdf, at least one of Rxf/Rxo, Ryf/Ryo and Rdf/Rdo satisfies conditions of 44.7%<Rxf/Rxo<77.6%, 59.0%<Ryf/Ryo<86.1% and 34.6%<Rdf/Rdo<69.2%.

10. The cathode ray tube according to claim 9, wherein the Ryo has the lowest value among the Rxo, Ryo and Rdo.

11. The cathode ray tube according to claim 9, wherein the Rxo, Ryo and Rdo are not less than 88% of a maximum value among the Rxo, Ryo and Rdo.

12. The cathode ray tube according to claim 11, wherein the Ryo has the lowest value among the Rxo, Ryo and Rdo.

13. The cathode ray tube according to claim 9, wherein the minimum value among the Rxo, Ryo and Rdo within the length H/12 from the center of the shadow mask substantially ranges between 85% and 88% of the maximum value among the Rxo, Ryo and Rdo, H being a minor-axis direction length of the shadow mask.

14. The cathode ray tube according to claim 13, wherein the Ryo has the lowest value among the Rxo, Ryo and Rdo.

15. The cathode ray tube according to claim 9, wherein the radius of curvature in the major-axis direction from the shadow mask center is Rxo, the radius of curvature in the minor-axis direction Ryo, the radius of curvature in the diagonal-axis direction Rdo, a radius of curvature at an end of an effective surface in the major-axis direction of the shadow mask Rxf, a radius of curvature at an end of an effective surface in the minor-axis direction Ryf, and a radius of curvature at an end of an effective surface in the diagonal-axis direction Rdf, at least one of Rxf/Rxo, Ryf/Ryo and Rdf/Rdo satisfies conditions of 62.6%<Rxf/Rxo<77.6%, 74.9%<Ryf/Ryo<86.1% and 52.1%<Rdf/Rdo<69.2%.

16. The cathode ray tube according to claim 9, wherein a thickness of the shadow mask is not greater than 0.1 mm.

17. The cathode ray tube according to claim 9, wherein a transmittance at a central portion of the panel is in a range of 45–75%.

18. A cathode ray tube comprising:

a panel having a fluorescent formed on an inner surface thereof;

a funnel connected to the panel;

an electron gun housed in the funnel, emitting electron beams;

a deflection yoke for deflecting the electron beams in horizontal and vertical directions;

a shadow mask for selecting colors of the electron beams; and a mask frame for supporting the shadow mask wherein an outer surface of the panel is substantially flat and an inner surface has a designated curvature, and a minor-axis direction length of the shadow mask is H, a radius of curvature from a center of the shadow mask in a major-axis direction is Rxo, a radius of curvature in a minor-axis direction Ryo, and a radius of curvature in a diagonal-axis direction Rdo, the Rxo, Ryo and Rdo within the length H/12 from the center of the shadow mask satisfy a condition of $$\frac{\mathrm{Max}(Rxo, Ryo, Rdo) - \mathrm{Min}(Rxo, Ryo, Rdo)}{\mathrm{Max}(Rxo, Ryo, Rdo)} \leq 0.15.$$

19. The cathode ray tube according to claim 18, wherein the radius of curvature in the major-axis direction from the shadow mask center is Rxo, the radius of curvature in the minor-axis direction Ryo, the radius of curvature in the diagonal-axis direction Rdo, a radius of curvature at an end of an effective surface in the major-axis direction of the shadow mask Rxf, a radius of curvature at an end of an effective surface in the minor-axis direction Ryf, and a radius of curvature at an end of an effective surface in the diagonal-axis direction Rdf, at least one of Rxf/Rxo, Ryf/Ryo and Rdf/Rdo satisfies conditions of 44.7%<Rxf/Rxo<77.6%, 59.0%<Ryf/Ryo<86.1% and 34.6%<Rdf/Rdo<69.2%.

20. The cathode ray tube according to claim 18, wherein the radius of curvature in the major-axis direction from the shadow mask center is Rxo, the radius of curvature in the minor-axis direction Ryo, the radius of curvature in the diagonal-axis direction Rdo, a radius of curvature at an end of an effective surface in the major-axis direction of the shadow mask Rxf, a radius of curvature at an end of an effective surface in the minor-axis direction Ryf, and a radius of curvature at an end of an effective surface in the diagonal-axis direction Rdf, at least one of Rxf/Rxo, Ryf/Ryo and Rdf/Rdo satisfies conditions of 62.6%<Rxf/Rxo<77.6%, 74.9%<Ryf/Ryo<86.1% and 52.1%<Rdf/Rdo<69.2%.

21. The cathode ray tube according to claim 18, wherein the Ryo has the lowest value among the Rxo, Ryo and Rdo.

22. The cathode ray tube according to claim 18, wherein a thickness of the shadow mask is not greater than 0.1 mm.

23. The cathode ray tube according to claim 18, wherein a transmittance at a central portion of the panel is in a range of 45–75%.

* * * * *